US006508746B1

(12) United States Patent
Jacobs et al.

(10) Patent No.: US 6,508,746 B1
(45) Date of Patent: Jan. 21, 2003

(54) MOGUL SKIING SIMULATING DEVICE

(76) Inventors: Terry G. Jacobs, P.O. Box 1275, Moses Lake, WA (US) 98837; Kevin Creelman, 104 Center St., Ste. 100, Kodiak, AK (US) 99615

( * ) Notice: Subject to any disclaimer, the term of this patent is extended or adjusted under 35 U.S.C. 154(b) by 0 days.

(21) Appl. No.: 09/911,405

(22) Filed: Jul. 25, 2001

(51) Int. Cl.[7] ..... A63B 22/08
(52) U.S. Cl. ..... 482/71; 482/51
(58) Field of Search ..... 482/51, 52, 53, 482/70, 71, 72, 111, 112, 146, 147, 79, 80, 148, 92

(56) References Cited

U.S. PATENT DOCUMENTS

| | | | |
|---|---|---|---|
| 3,421,760 | A | 1/1969 | Freeman, Jr. |
| 3,831,935 | A | 8/1974 | Höfle |
| 3,912,260 | A | 10/1975 | Rice |
| 5,162,029 | A | 11/1992 | Gerard |
| 5,484,363 | A | 1/1996 | Creelman et al. |
| 5,536,225 | A | 7/1996 | Neuberg et al. |
| 5,613,856 | A | 3/1997 | Hoover |
| 5,665,033 | A | 9/1997 | Palmer |
| 5,993,358 | A | 11/1999 | Gureghian et al. |
| 6,231,484 | B1 | 5/2001 | Gordon |

FOREIGN PATENT DOCUMENTS

| | | | |
|---|---|---|---|
| JP | 9000671 | A | 1/1997 |

*Primary Examiner*—Stephen R. Crow
(74) *Attorney, Agent, or Firm*—Richard C. Litman

(57) ABSTRACT

A mogul skiing simulating device having a floating platform riding bearings on crank pins of two crankshaft assemblies while accommodating the changing distance between the two crankshaft pins during their rotation. The leader crankshaft assembly is about 30 to 35 degrees ahead of the follower. The platform is tethered by springs to its central support to maintain the platform in the correct relation to both pairs of crankshaft assemblies. The springs pull from a plastic bushings on each crankshaft pin toward the center of the platform. The tilt of the entire machine is higher in the rear to simulate downhill skiing. Cams may be attached to the front and rear crank journals which act upon the ends of a leaf spring to store and release energy. The crankshafts are turned by and electrically powered "V" drive. Railing allows the user to vary hand placement and body position.

20 Claims, 14 Drawing Sheets

MOGUL SKIING SIMULATING DEVICE

BACKGROUND OF THE INVENTION

1. Field of the Invention

The present invention relates to ski simulators and exercisers. More particularly, the present invention relates to an alpine mogul skiing simulator and exerciser.

2. Description of the Related Art

Exercising devices for conditioning muscle groups are well known. Typically, exercise devices include elemental components dimensioned and configured to interact together to encourage a particular movement of one or more muscle groups. Alpine mogul skiing has become a competitive sport in recent years. During this event the skiers are subjected to substantial repetitive vertical motion combined with differing slope angles which are mainly absorbed by bending of the legs at the knees. It would be desirable to provide an alpine mogul skiing simulator which would assist in training and exercising the muscle groups associated with alpine mogul skiing.

U.S. Pat. No. 3,831,935, issued Aug. 27, 1974, to Höfle, describes a movable platform exercising device having two crank arms attached to a frame. The double crank arms revolve about a horizontal axle. The inner arms of the double crank are connected to at least one movable platform upon the frame. Handle bars are pivotally attached to the outer arms of the double cranks. In operation a user stands on the platform, grasping the handle bars. By shifting his or her weight, the platform is caused to move in a circular motion. As the platform rises, the handle bars lower, and vice versa. The motion of the platform is opposed by a plurality of springs which tend to maintain the platform in a horizontal attitude as it moves vertically.

U.S. Pat. No. 3,421,760, issued Jan. 14, 1969, to Freeman, Jr. describes a foot exerciser with platforms for each, foot having a network of springs to resist and counterbalance both the forward motion of the foot as well as the angle of the foot during forward motion.

U.S. Pat. No. 5,665,033, issued Sep. 9, 1977, to Palmer, describes a ski simulating exercise machine in which the force and motion of the legs are opposed by platforms for each foot. The platforms are suspended by a system of hydraulic cylinders which move the foot platforms in a diagonal or "X" pattern.

U.S. Pat. No. 3,912,260, issued Oct. 14, 1975, to Rice describes a downhill skiing simulator which includes a structural frame bearing a ski pole simulator and a turntable which is hydraulically rotatable, back-and-forth in a horizontal plane and a rocker pivotal about a horizontal axis, also hydraulically actuated. The pivotal rocker carries a carriage to which is attached a ski mounting means. The carriage slides by gravity from one end of the rocker to the other, as the rocker and turntable are pivoted by motive means, while the skier grasps handles of the ski pole simulator and performs various ski simulating maneuvers. The device simulates lifting a skier to the top of a slope and then simulates allowing him to descend the slope. During the descent, he is rotated or pivoted so that he must simulate the body movements required of a skier while making a turn.

U.S. Pat. No. 5,162,029, issued Nov. 10, 1992, to Gerard describes a simulated ski slope of the type having and an inclined deck and a continuous belt of material formed in a closed loop around rollers at the top and bottom of the slope. A mogul simulator may be attached to the continuous belt.

U.S. Pat. No. 5,536,225, issued Jul. 16, 1996, to Neuberg et al. describes a ski training and exercise system providing both stepping action and swinging action combined in various ways and providing drag or braking action through cables to springs or braking devices. Mogul skiing simulation is provided by allowing tandem operation of the foot supports with drag provided by springs.

U.S. Pat. No. 5,613,856, issued Mar. 25, 1997, to Hoover, describes a support allowing a person to practice ski turns while wearing his or her own skis. A base unit is provided which may include an upper sheet supported by resilient material such as high-density closed cell foam. The upper sheet may also be supported by springs or a continuous ribbed belt. Turns may be executed on the upper sheet.

U.S. Pat. No. 5,993,358, issued Nov. 30, 1999, to Gureghian et al. describes a treadmill with adjustable bound and rebound.

U.S. Pat. No. 6,231,484 B1, issued May 15, 2001, to Gordon, describes an snow skiing simulator exercise machine. Elongated foot support arms, the front ends of which are pivotally connected to a tubular frame for multiple axes rotation and are interconnected by a tie bar for coordinated movement. Handle bars on a post pivotally attached to the frame and a tie bar creates a lateral motion of the handle bars oppositely timed with the foot support arms for upper body balance and conditioning. Damping cylinders add variable resistance during a workout.

Japanese Patent No. 9-671, published January 1997 describes a body weight shifting exercise simulating skiing movement by providing a frame with a handle bar and a shifting main shaft and spring stabilized foot seats. The machine is operated by the user's shifting of his body weight.

None of the above inventions and patents, taken either singularly or in combination, is seen to describe the instant invention as claimed. Thus, a mogul skiing simulating device solving the aforementioned problems is desired.

SUMMARY OF THE INVENTION

The present invention is a device which simulates mogul skiing, and is an improvement of the present inventors' U.S. Pat. No. 5,484,363. Mogul skiing conditions are simulated using a floating platform that rides on bearings on the crank pins of two crankshaft assemblies of equal size to accommodate the changing distance between the two crankshaft pins during their rotation. The changing distance is achieved by the positioning a leader crankshaft assembly about 30 to 35 degrees ahead of a follower crankshaft assembly. The platform is tethered by springs to its central support to maintain the platform in the correct relation to both pairs of crankshaft assemblies. The springs pull from a plastic bushings on each crankshaft pin toward the center of the platform. The crankshaft pins rotate within these bushings as the crankshafts turn during operation. The opposing pulling forces keep the platform centered between the two pairs of crankshafts as the distance changes. The tilt of the entire machine is preferably higher in the rear to simulate downhill skiing. Cams may be attached to the front and rear crank journals which act upon the ends of a leaf spring which stores energy upon the downward travel of the crankshafts which is released by assisting in the upward movement of the crankshafts, resulting in lower electrical power requirements.

Plastic coverings are used on the surfaces to protect the operator from mechanical parts and to enhance the appearance of the device. In the stationary/rotary interface, the inside flat portion is plastic or other material and includes circular cutouts for the radius of the crankshaft travel. Disks of plastic or other material are attached to the respective crankshaft assemblies and are approximately the same size and have the same center as the cutouts in the flat portions.

Railing is provided for safety and to allow the user to vary hand placement and body position. A front crossing portion connects steep, nearly vertical front inclined portions, simulating the angle of ski pole grips, which are connected to mildly forward tilting parallel portions extending to nearly vertical rear portions attached to the rear of the device housing.

A motor drive provides variable speed, fulfills machine requirements, and connects to a 120-volt outlet. The motor drive converts 120-volt single-phase current to 230-volt three-phase current to power a 230-volt motor. The drive allows the user to control the torque, speed, and related parameters by means of a control key pad located on the forward railing. The brake module dissipates the electric energy generated on the downward part of the crankshaft rotation cycle. The brake module also provides precision and emergency stopping capabilities. The motor is located between the two crankshaft assemblies. The motor drives a double sprocket, driving separate chains to each crankshaft assembly.

Accordingly, it is a principal object of the invention to provide an exercise apparatus which closely simulates alpine mogul skiing.

It is another object of the invention to provide a power drive exercise apparatus including a pair of rotational components operative linked to one another and a platform supported by the pair of rotational components especially suitable for simulating alpine mogul skiing conditions.

It is a further object of the invention to provide an exercise apparatus as above wherein the disposition of the platform varies in accordance with the rotational displacement of the pair of rotational components.

It is still another object of the present invention to provide an apparatus as above wherein the platform assumes an inclined orientation at the top of the rotation of the leading rotational component and a declined orientation at the bottom of the rotation thereof.

It is yet another object of the present invention to provide an exercise apparatus which is power driven at a variable speed and that provides controls and a safety element for interrupting the operation of the apparatus.

It is still another object of the invention to provide a housing to protect the user from moving parts.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
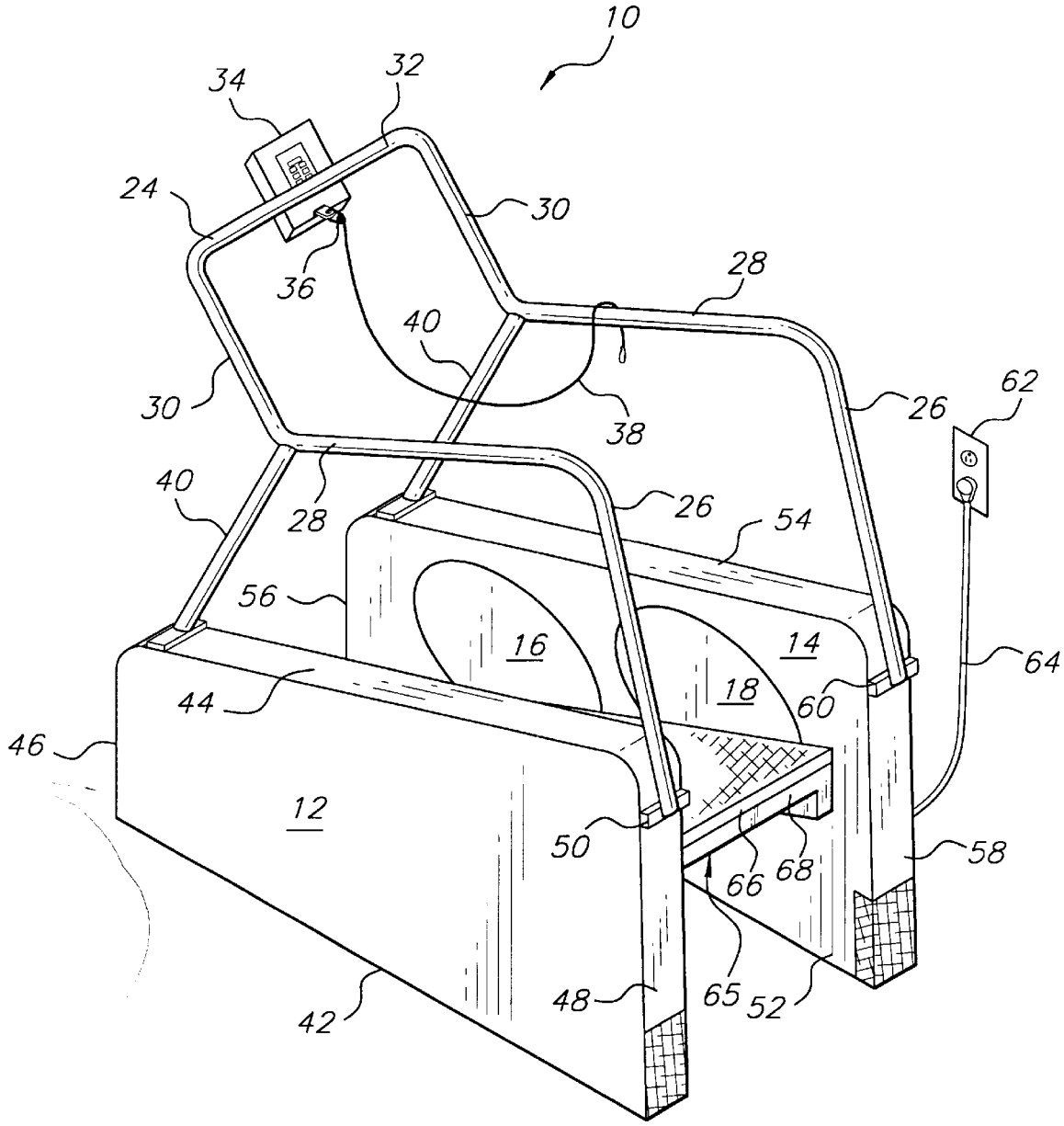
FIG. 1 is an environmental, perspective view of a mogul skiing simulating device according to the present invention.
Figure 2:
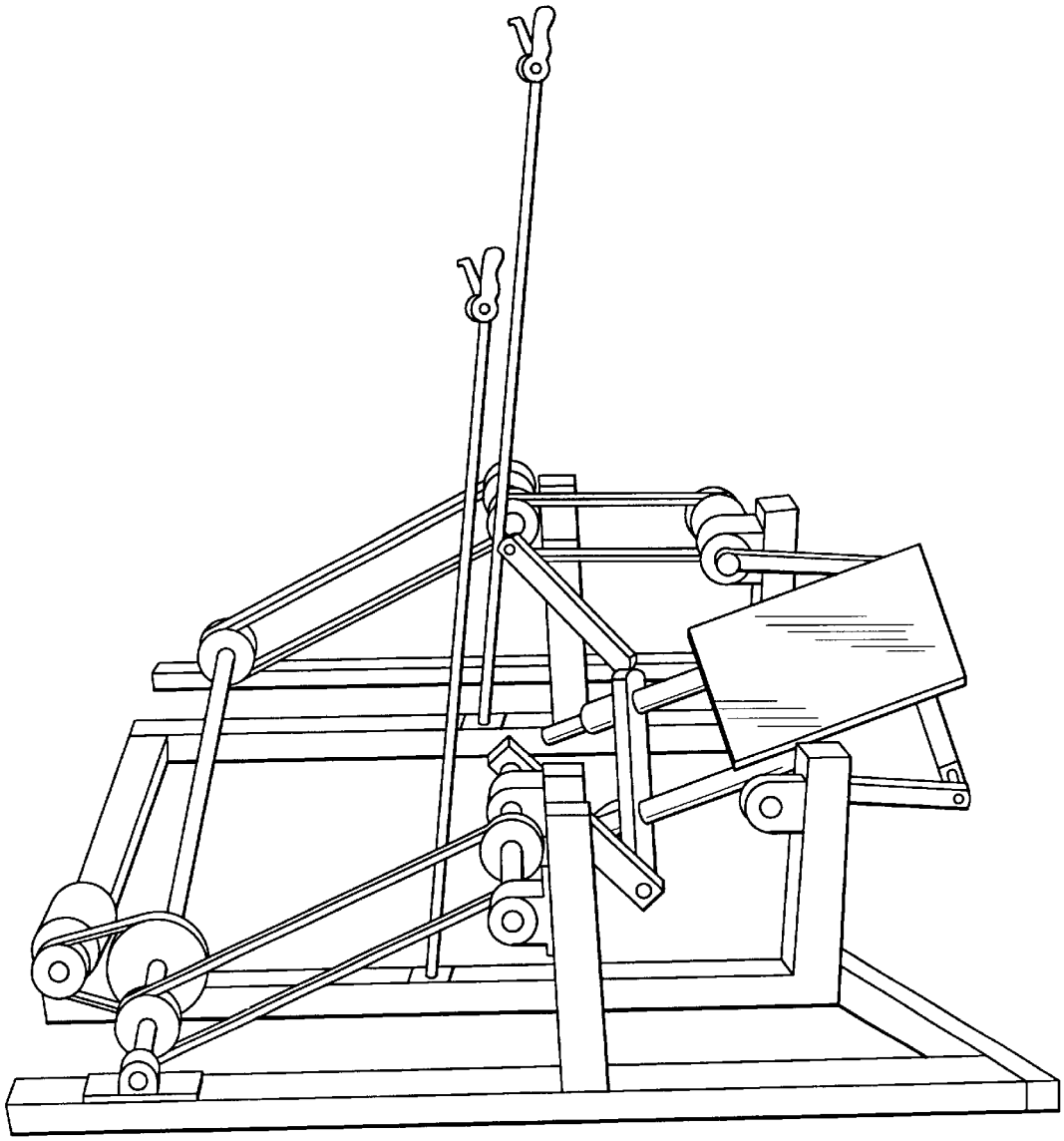
Fig. 2 (PRIOR ART)
FIG. 2 is a depiction of a prior art mogul skiing device.

The present invention is a device which simulates mogul skiing and is an improvement of the present inventors' U.S. Pat. No. 5,484,363, issued Jun. 16, 1996 to Creelman et al. as depicted in FIG. 2. This device provides a platform which is secured at its rear end to a rear crank pin of a crank assembly and travels in a circular motion around the horizontal axis of the crank journals. The front crank pin of a similarly disposed crank assembly slidingly attached to the front of the platform as it rotates around its respective crank journals. The front crank assembly rotates about 20 degrees ahead of the rear crank assembly resulting in an alternating upward and downward slant of the platform rotating around the rear crank pin.

It would be desirable to have a system where the entire platform is raised or lowered and slanted the same amount and at the same angles at all parts of the platform so alpine mogul skiing conditions are simulated at all points on the platform.

The prior patent also only has hand holds simulating parallel ski poles. It would be desirable if a variety of handholds were provided to provide alternative skiing stances. It would also be desirable if provision was made to tilt the entire simulator forward to further simulate downhill skiing. It would also be desirable to provide a more compact drive design and provide protective housings for moving parts. Provision for storing energy developed upon descent of the platform for use when raising the platform would also be desirable.

In the present inventive device, the above-mentioned desired characteristics are provided while mogul skiing conditions are simulated using a floating platform that rides on bearings on the crank pins of two crankshaft assemblies of equal size to accommodate the changing distance between the two crankshaft pins during their rotation. The changing distance is achieved by the positioning a leader crankshaft assembly about 30 to 35 degrees ahead of a follower crankshaft assembly. The platform is tethered by springs to its central support to maintain the platform in the correct relation to both pairs of crankshaft assemblies. The springs pull from a plastic bushings on each crankshaft pin toward the center of the platform. The crankshaft pins rotate within these bushings as the crankshafts turn during operation. The opposing pulling forces keep the platform centered between the two pairs of crankshafts as the distance changes.

This spring system may be used in conjunction with springs or bumper cushions which push away from the ends of the platform to reduce any impact of crankshaft pins with platform ends. The need for these springs or bumper cushions may be eliminated by employing variable tension tether springs which increase in resistance as they are extended.

The tilt of the entire machine is preferably higher in the rear to simulate downhill skiing. Cams may be attached to the front and rear crank journals which act upon the ends of a leaf spring which stores energy upon the downward travel of the crankshafts which is released by assisting in the upward movement of the crankshafts, resulting in lower electrical power requirements.

Referring to FIGS. 1 and 3–5, there is shown an environmental perspective view of the present invention and views of the inventive device in an upward position, a forward position, and a traverse position. Mogul simulation device 10 features left side housing 12 having crank covers (not shown) and right side housing 14 which includes right front crank cover 16 and right rear crank cover 18. Hand rail 24 includes rear rail upright portions 26, side rail parallel portions 28, rail front inclined portions 30, and front rail cross portion 32. The rail may be at least partially covered with rail grip material 33(see FIG. 6).

Rail touch control pad 34 is preferably located on front rail cross portion 32 and includes emergency stop switch 36 activated by stop switch lanyard 38 which may be attached to the user and activated if the user falls. Stanchions 40 support hand rail 24 at a point between the rail inclined portions 30 and rail parallel portions 28 and rest on the front portions of left and right side housings 12 and 14, respectively.

Left side housing 12 includes left housing base 42, left housing top 44, left housing front 46, and left housing rear 48, which bears left housing rail support 50 for supporting hand rail 24 at its respective rear upright portion 26. Right side housing includes right housing base 52, right housing top 54, right housing front 56, and right housing rear 58, which bears right housing rail support 60 for supporting hand rail 24 at its respective rear upright portion 26. The 120 volt AC plug outlet 62 provides electrical power to power cord 64, ultimately providing the energy to move floating platform 65 having cover 66 and support frame 68.

Figure 3:
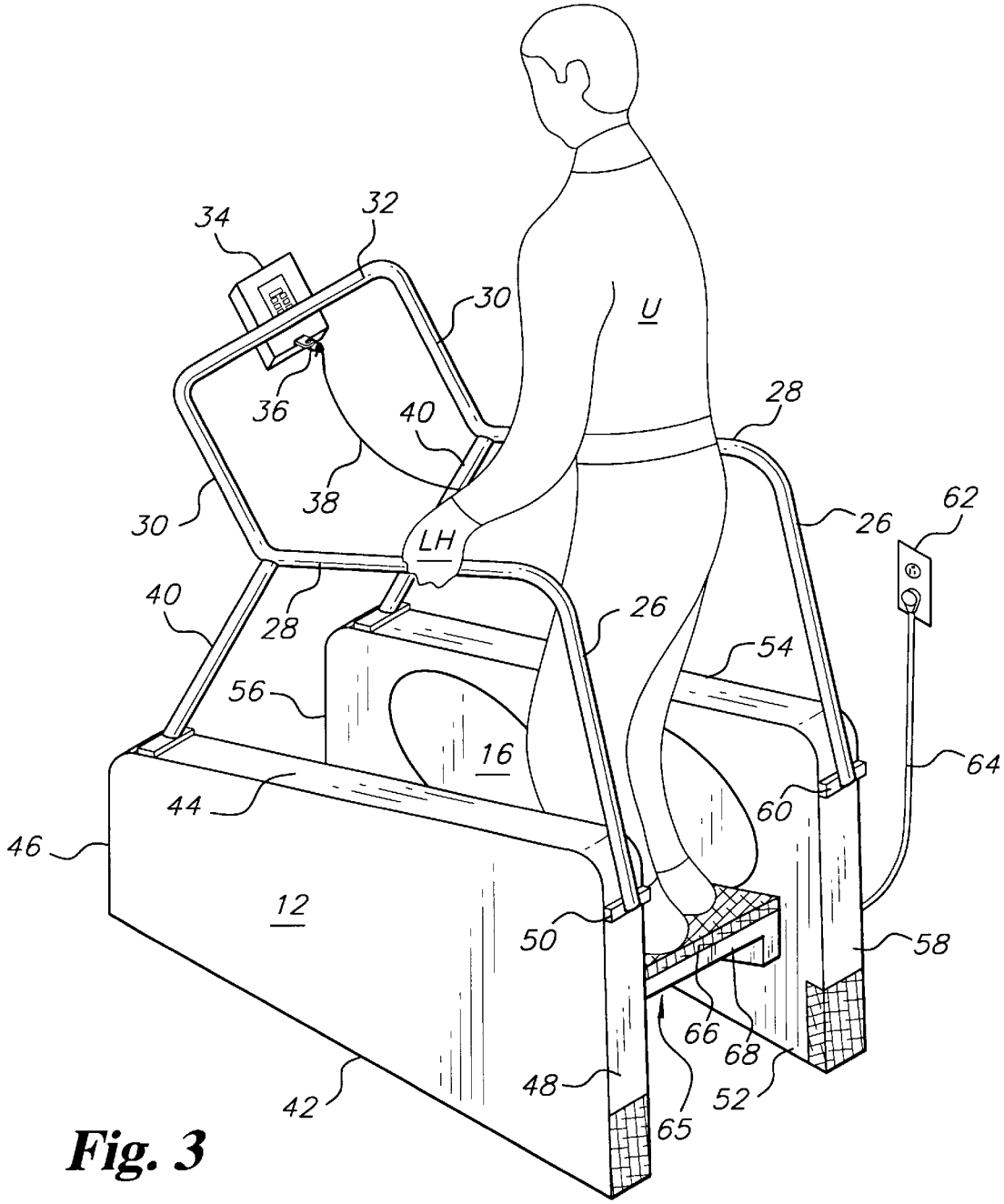
FIG. 3 is an environmental perspective view of the device of FIG. 1, showing a user having positioned himself by a grip of the mid-portion of the railing, the floating platform being near the bottom of its travel.
Figure 4:
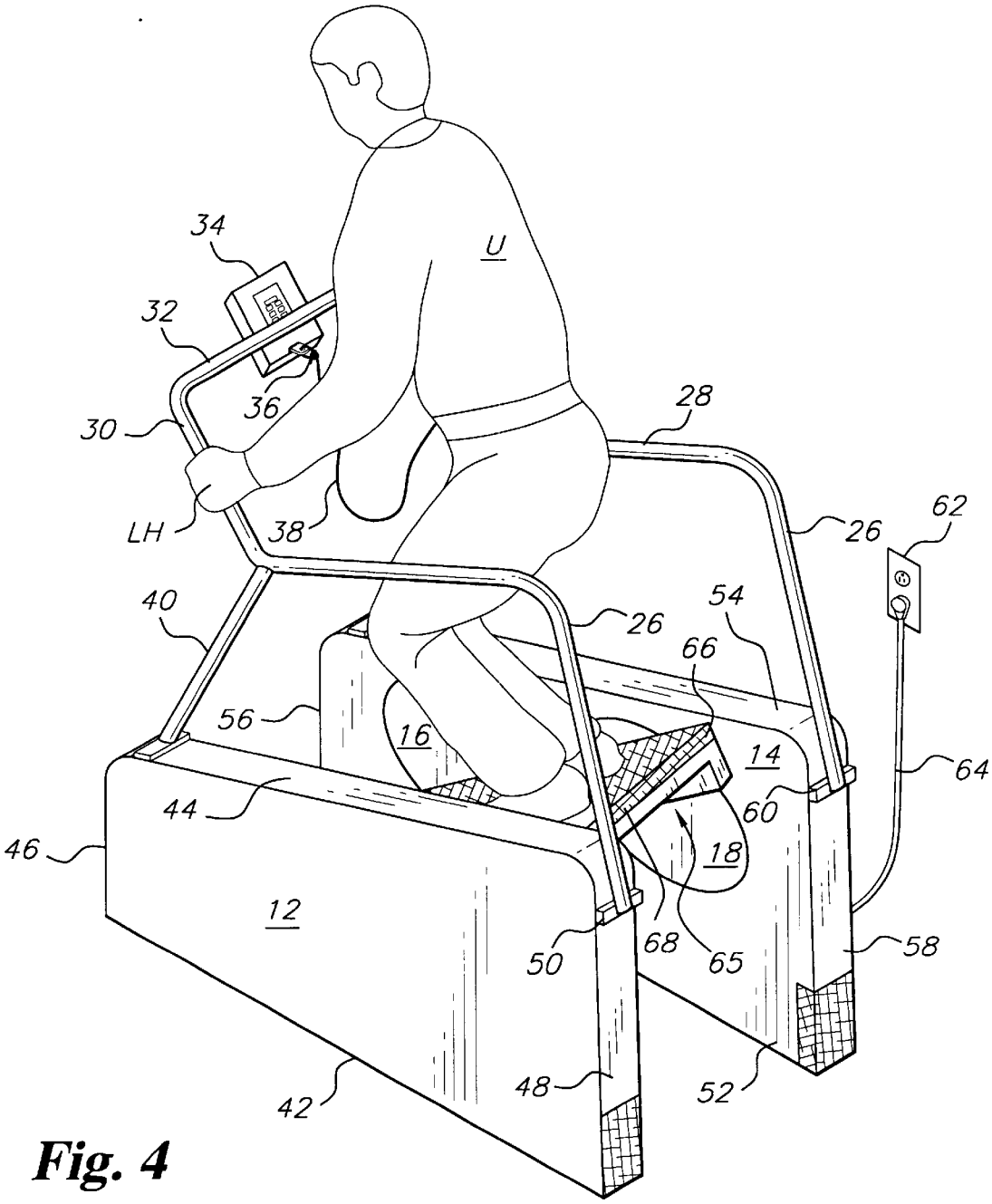
FIG. 4 is an environmental perspective view of the device of FIG. 1, showing a user having positioned himself forward by gripping the front portions of the railing, the floating platform being in a forward tilted position as it is starting downward from the top of its travel.
Figure 5:
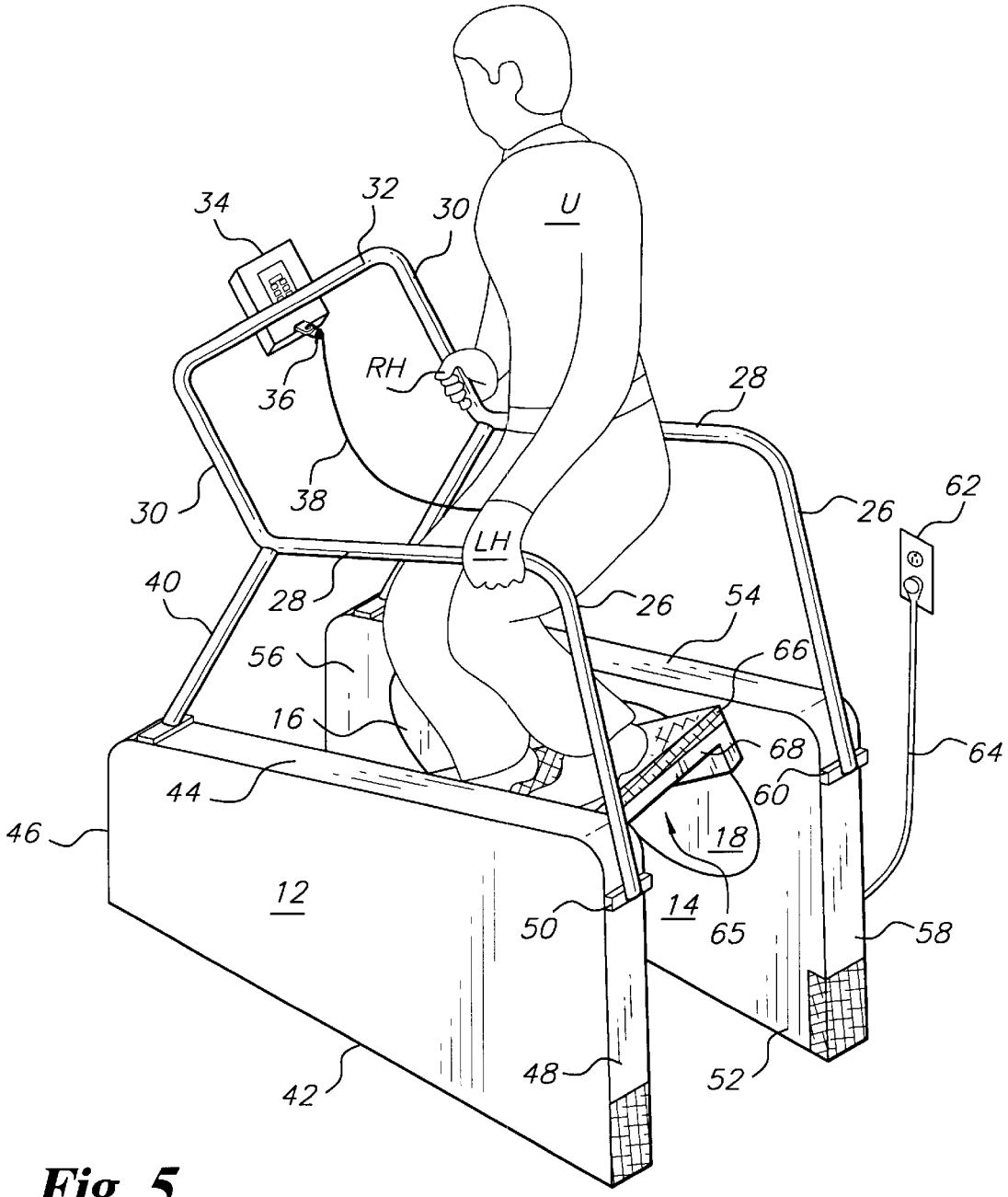
FIG. 5 is an environmental perspective view of the device of FIG. 1 showing a user having positioned himself in traverse position by gripping a front railing portion with his right hand and gripping a railing mid-portion with his left hand, the floating platform being in a forward tilted position as it is starting downward from the top of its travel.

The user U as shown in FIG. 3 stands relatively upright on platform 65 with his feet nearly even and his left hand LH and right hand(not shown) gripping the mid-portions of parallel rail portions 28, simulating skiing on a relatively gentle slope. This position is useful for warmup or general aerobic exercise. The user U as shown in FIG. 4 is positioned in a forward position on platform 65 with his feet nearly even and his left hand LH and right hand(not shown) gripping the front inclined portions 30, simulating skiing on a relatively steep slope. The user U as shown in FIG. 5 stands in a traverse position with feet spaced along the platform 65 at a large angle, his body twisted to a substantially forward position in the upper trunk, his left hand LH gripping the respective rear portion of parallel rail portion 28 and his right hand RH gripping a lower portion of respective front inclined portion 30, simulating snow boarding.

Figure 6:
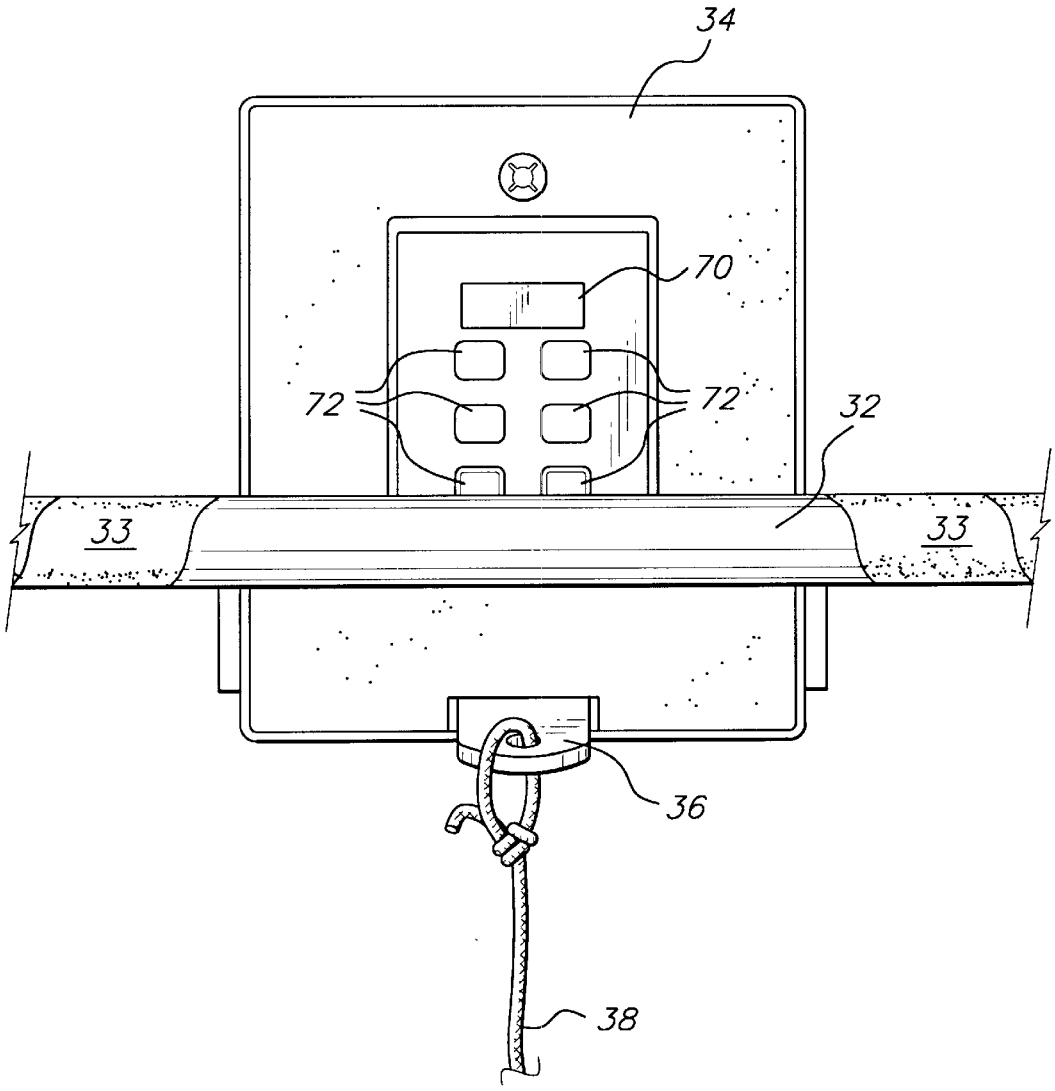
FIG. 6 is an elevational view of the control keypad of the present invention as it is mounted on the front crossbar of the railing.

As is seen in FIG. 6, touch control pad 34 features emergency stop switch 36 activated by stop switch lanyard 38 and is mounted on rail front cross portion 32. Touch control pad 34 includes readout display 70 and control buttons 72. Readout display 70 may display such information as machine speed and buttons 72 may control machine speed, torque, or other parameters.

FIG. 2 illustrates a prior art mogul skiing simulator invented by the instant inventors.

Figure 7:
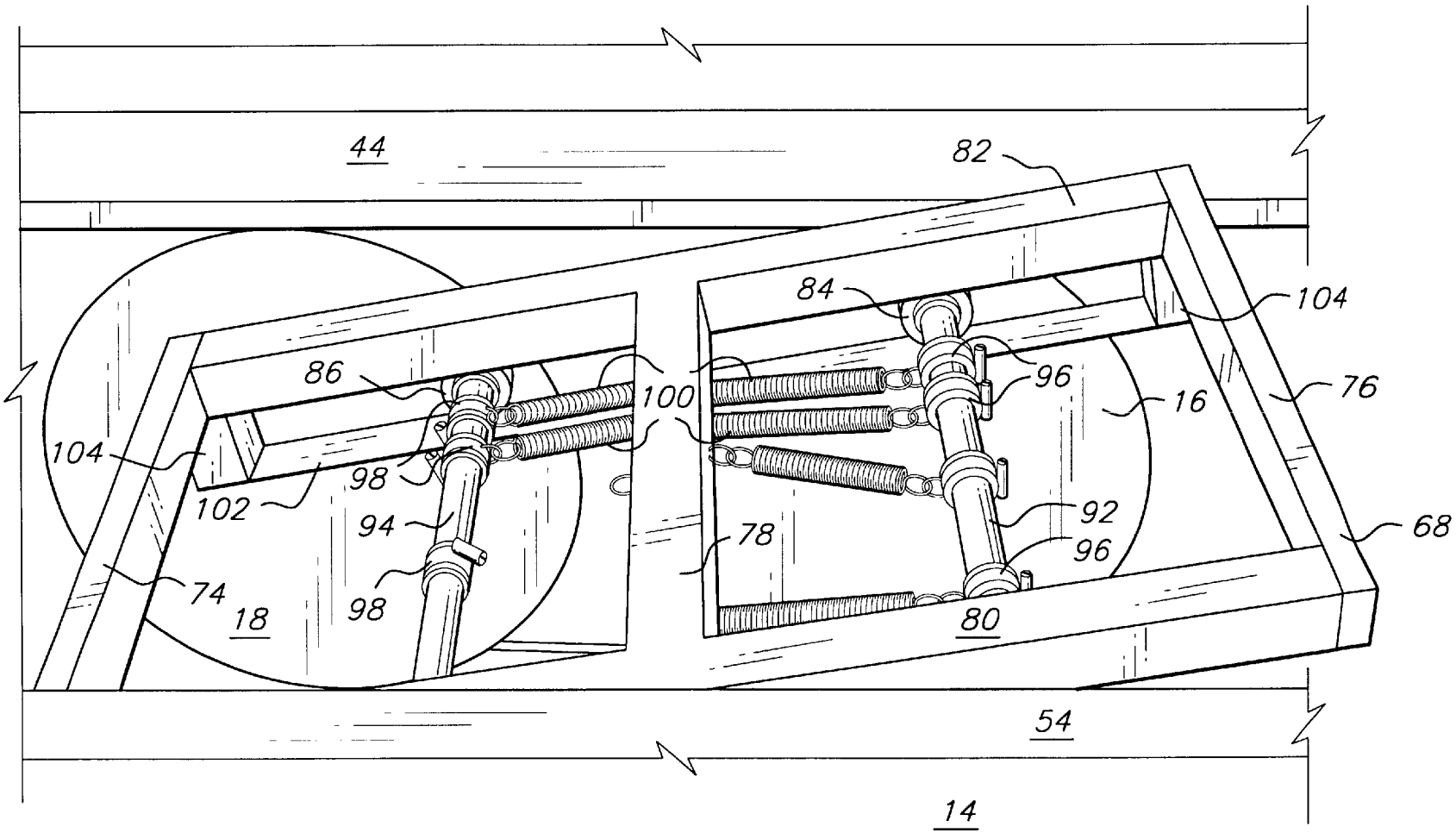
FIG. 7 is a detail view of the platform support of the present invention with the cover of the platform removed.

Referring to FIG. 7 is a detail view of the platform frame as supported on front and rear crankshaft bearings and pins. Platform frame 68 is generally rectangular in form and includes rear cross member 74, front cross member 76, center cross member 78, right side member 80, and left side member 82. Frame 68 is supported by left front platform support bearing 84, left rear platform support bearing 86, and right front and rear platform support bearings 85 and 87, respectively(See FIG. 12). Left support bearings 84 and 86 are free to travel within left side member 82 in an underside groove(not shown) along the length of side member 82. Right support bearings 85 and 87 are free to travel within right side member 80 in an underside groove(not shown) along the length of right side member 80.

Platform frame 68 is tethered by tension springs 100 to center cross member 78 to maintain frame 68 in the correct relation to front crank pin 92 and rear crank pin 94. A desired number of springs 100 are connected with front crank pin 92 by means of front spring bushing mounts 96. Springs 100 are connected with rear crank pin 94 by means of rear bushing mounts 98. The number and angle of attachment of springs 100 are selected to maintain floating platform 65 in desired positions during operation of the inventive device. Platform frame 68 has depending supports 104 located at each corner which support limit bars 102 which are located parallel with and underneath respective right side member 80 and left side member 82 so spaced therefrom that frame 68 is retained upon undue lifting above left support bearings 84 and 86 and right support bearings 85 and 87.

Figure 8:
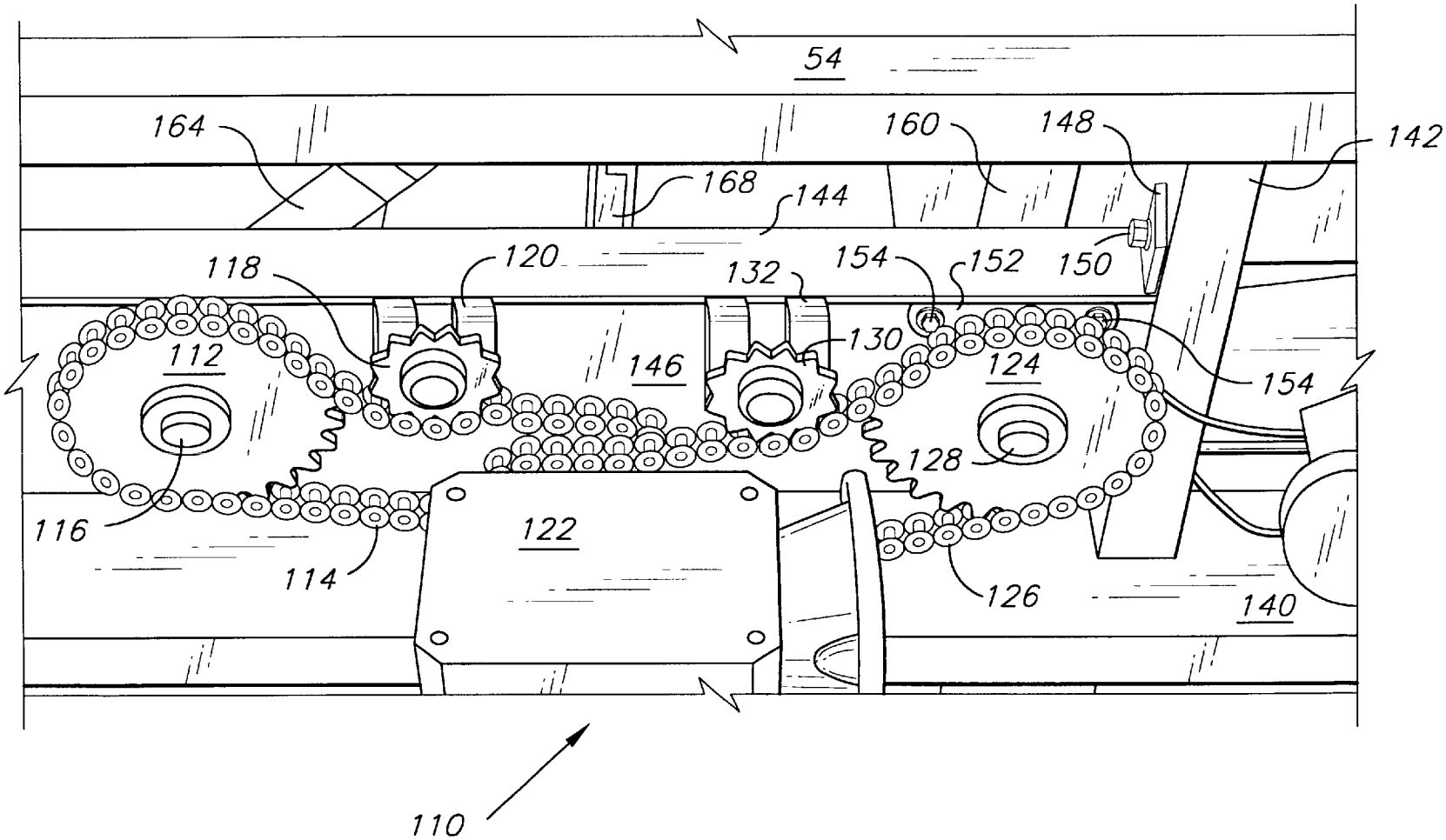
FIG. 8 is an environmental perspective view of the "V" drive system of the present invention.
Figure 9:
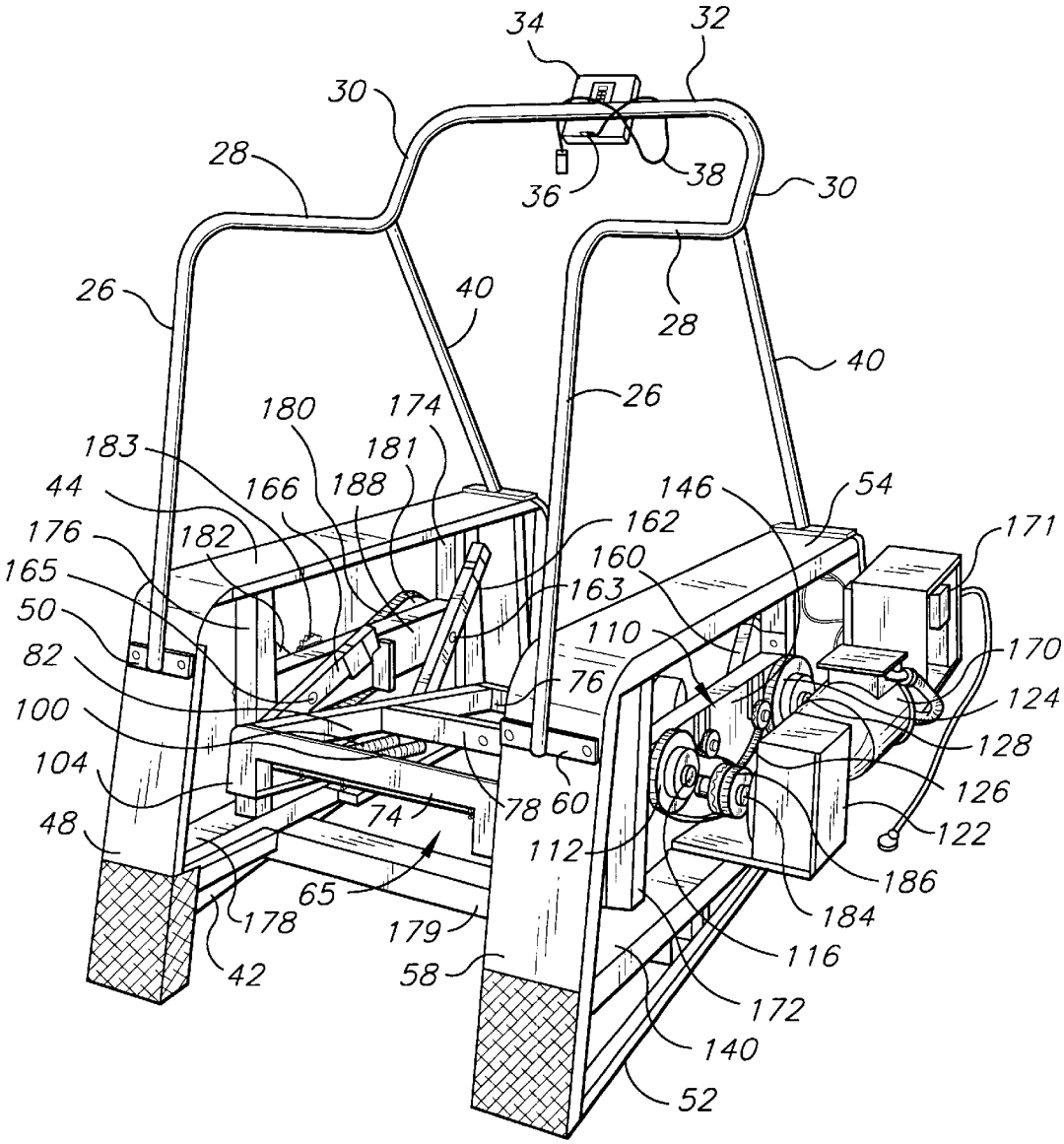
FIG. 9 is an environmental perspective view of the present invention with the housing removed.

Referring to FIGS. 8 and 9 there is shown a detail view of the "V" drive as mounted and a perspective view of the overall mogul skiing device with walls and crank covers removed, respectively. "V" drive 110 includes rear drive sprocket 112 driven by rear drive chain 114 having rear chain tensioner 118, drive sprocket 112 thereby turning right rear crank journal 116, Rear chain tensioner 118 is adjustably mounted on rear chain tensioner bracket 120. Chain drive unit 122 rotates driver shaft 184 by means of drive sprockets 186 mounted for rotation thereon. Front drive sprocket 124 is driven by front drive chain 126 having front chain tensioner 130, drive sprocket 124 thereby turning right front crank journal 128. Front chain tensioner 130 is adjustably mounted on front tensioner bracket 132.

Right frame sloping member 140, right frame front stanchion 142, mounting flange 144 of right mounting wall 146, and right rear stanchion 172 form a frame for supporting "V" drive 110 and drive unit 122. Mounting flange 144 of right mounting wall 146 is mounted to right front stanchion 142 by front mounting flange tab 148 and to right rear stanchion 172 by similar means(not shown). Front journal bearing support 152 is fastened to right mounting wall 146 by bolts 154. A rear bearing support(not shown) is similarly fastened.

Front right crank 160 rotates with right front crank journal 128. Left front crank 162 rotates with left front crank journal 163. Right rear crank 164 rotates with right rear crank journal 116. Left rear crank 166 rotates with left rear crank journal 165. Front crank pin 92(see FIG. 7) connects right front crank 160 and left front crank 162 and supports the front portion of floating platform 65 by means of bearings 84 and 85 as previously described. Rear crank pin 94 connects right rear crank 164 and left rear crank 166 by means of bearings 86 and 87 as previously described. The free portions of front cranks 160 and 162 extending away from crank pin 92, and the free portions of rear cranks 164, and 166 extending away from crank pin 94, respectively, serve no function other than to assist in mounting the crank covers.

Left frame sloping member 178, left frame front stanchion 174, left mounting wall 188, and left rear stanchion 176 form a frame for supporting idler chain 180 rotating with idler front sprocket wheel 181, idler rear sprocket wheel 182 and idler chain tensioner 183. The idler sprocket wheels and chain help maintain the front and rear crank pins 92 and 94 in the proper angular relationship and is made up of a front sprocket wheel mounted to front left crank journal 163, a rear sprocket wheel mounted to rear left crank journal 165 a driving chain rotating with the front and rear sprocket wheels, and a tensioner to adjust tension on the driving chain. Frame cross member 179 extends between left housing base 42 and right housing base 52 and helps support left frame sloping member 178 and right frame sloping member 140. Right frame, sloping member 140 also supports the assembled drive unit 122, electric motor 170, and electric power converter 171 as seen in FIG. 9.

Figure 10:
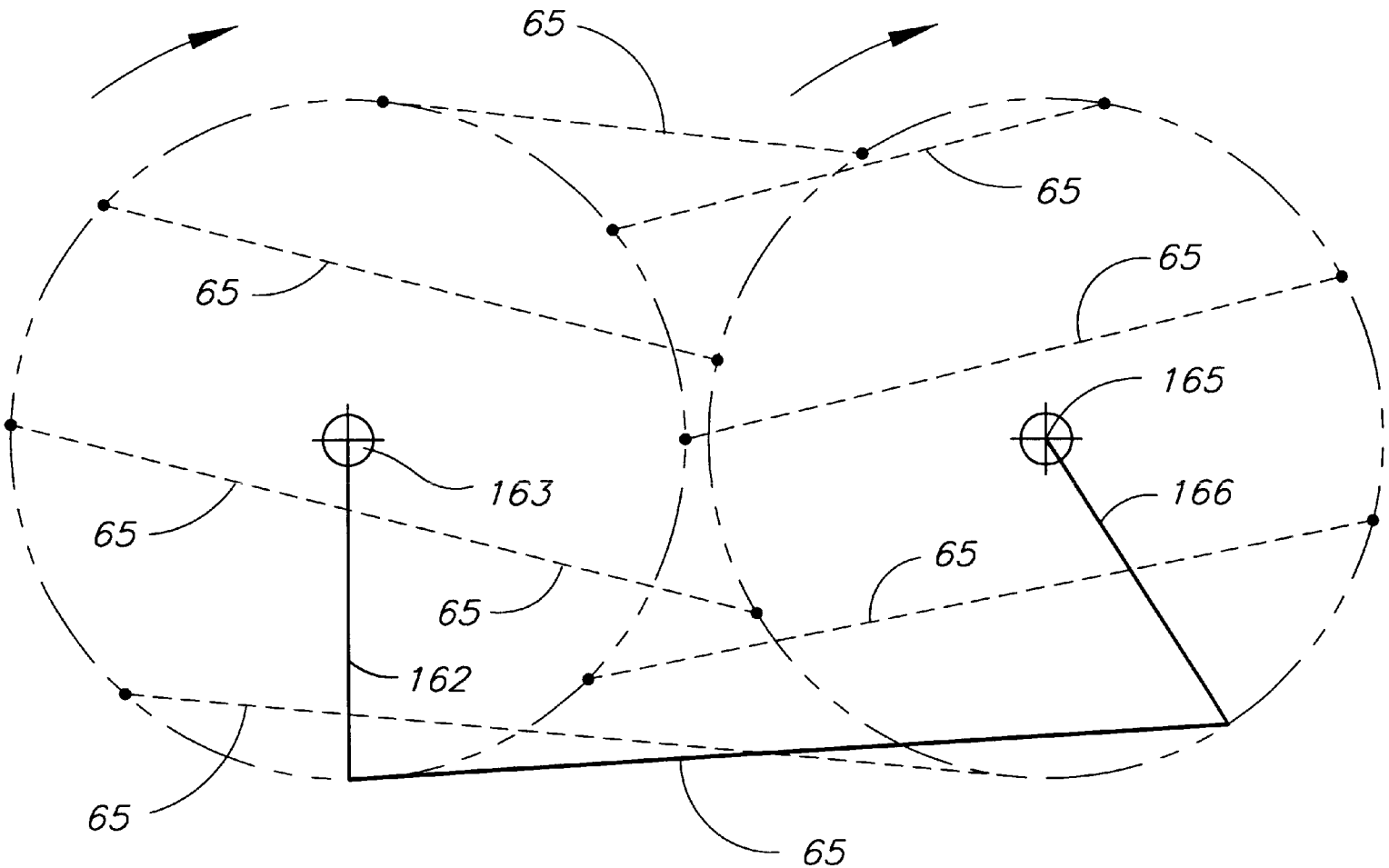
FIG. 10 is a diagrammatic representation of the floating platform as it moves relative to the front and rear axles as they rotate through 360 degrees.

FIG. 10 is a diagrammatic representation of the floating platform as it moves relative to the front and rear axles as they rotate through 360 degrees. Left front crank 162 rotates with left front crank journal 163, and left rear crank 166 rotates with left rear crank journal 165 about 30–35 degrees behind left front crank 162. The positions of floating platform 65 are shown by dotted lines as cranks 162 and 166 rotate through 360 degrees. It can be appreciated that a user standing on floating platform 65 and facing forward(toward the left of the figure) would experience the simulation of transitioning from a downhill position at the bottom to an uphill position as the cranks rotate in the direction of the arrows. Upon further radial travel, the user experiences a steepening attitude until transitioning back to a downward attitude at the top of radial travel, the user then assumes a descending attitude as the platform travels downward to complete the 360 degrees of travel. This simulates the skier's motion during the negotiation of moguls.

Figure 11:
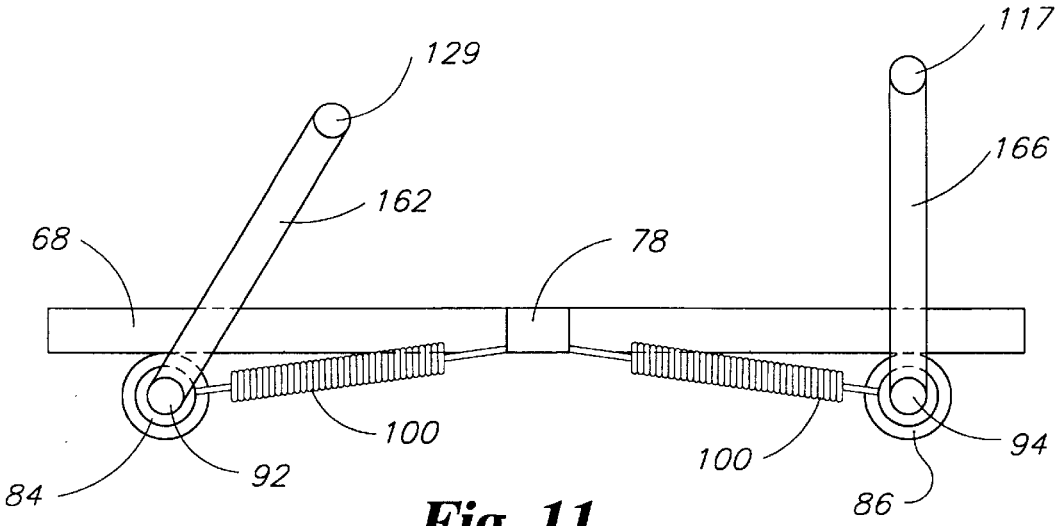
FIG. 11 is a diagrammatic elevation view of a floating platform as above with the platform at its bottom position.
Figure 12:
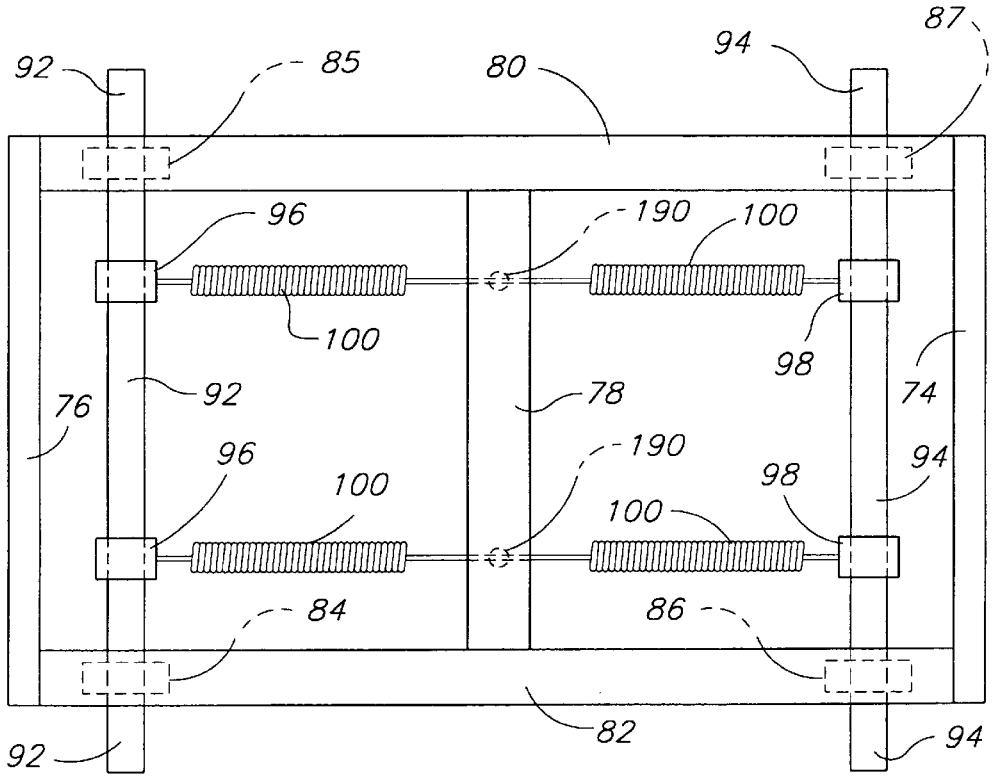
FIG. 12 is a diagrammatic plan view of the floating platform of FIG. 11.

Referring to FIGS. 11 and 12 there is shown a diagrammatic elevation view of the floating platform at its bottom position, and a diagrammatic plan view of the floating platform of FIG. 11. FIGS. 11 and 12 illustrate how frame 68 of floating platform 65(see FIG. 1) is tethered by springs 100 to crank pins 92 and 94. As is seen, center cross member 78 has spring center mounts 190 distributed to receive one end of each of springs 100, along it under side, while front pin bushing spring mounts 96 receive the other end of the front mounted springs, and rear pin bushing spring mounts 98 receive the other end of the rear mounted springs.

As can be envisioned, floating platform frame 68 is free to move relative to bearings 84 and 85 and to bearings 86 and 87 as crank pins 92 and 94 move relative to each other, but the frame is tethered by the springs 100 to maintain the platform in a relatively centered position during operation of the inventive device. This spring system may be used in conjunction with springs or bumper cushions(not shown) which push inward, away from the ends of the platform to reduce any impact of crankshaft pins with platform ends 74 and 76.

Figure 13:
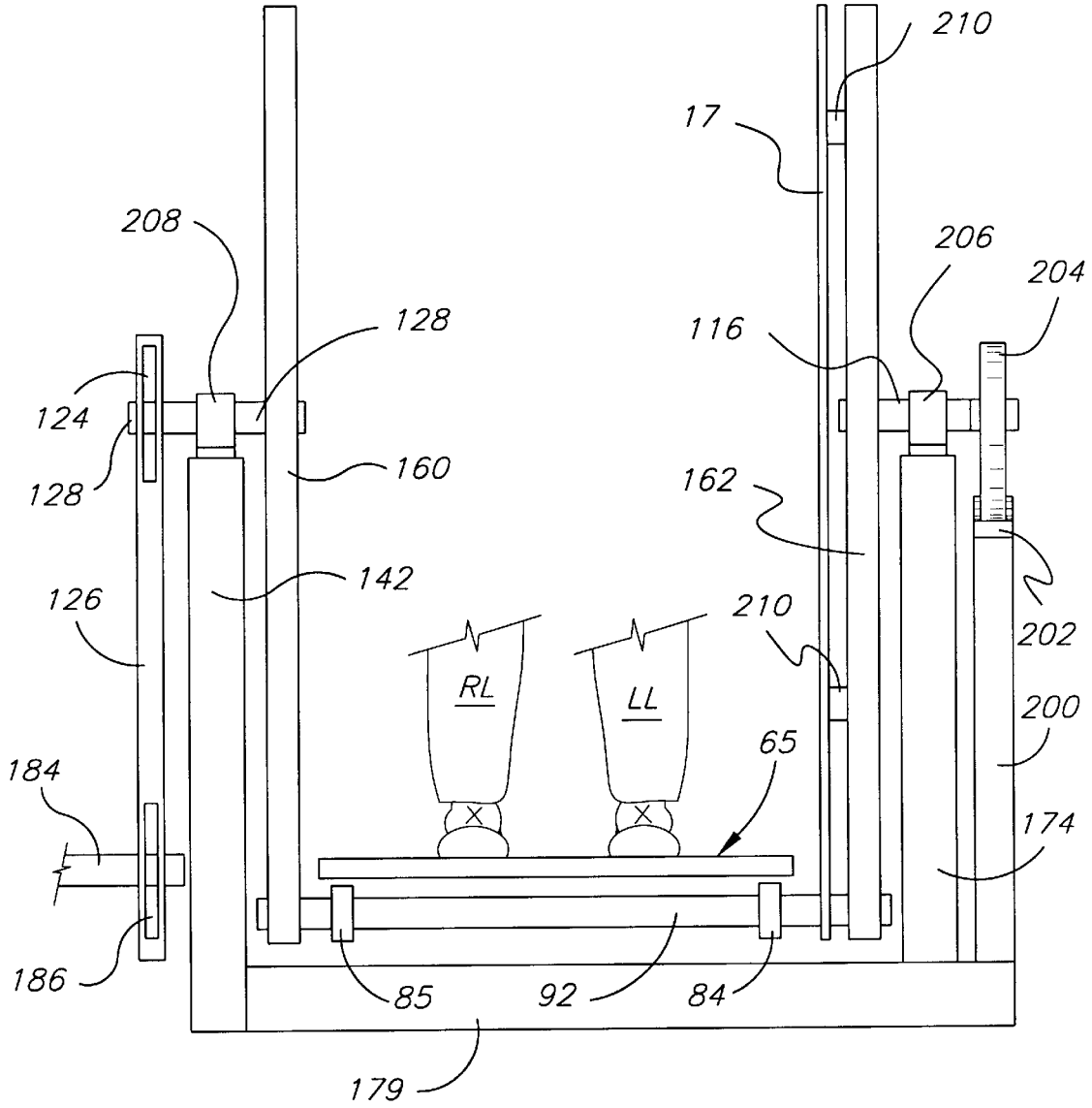
FIG. 13 is a diagrammatic front view of the present invention illustrating support elements with the floating platform located at its bottom position.

Referring to FIG. 13, there is shown a diagrammatic front elevation view of the present invention with the platform in its lowest position and illustrating the leaf spring energy saving feature wherein floating platform cover 65 is supporting the left leg LL and the right leg RL of the user U. The front portion of the platform is supported by bearings 84 and 85 mounted on front crank pin 92. Front crank pin 92 separates right front crank 160 and left front crank 162, which are attached to right front crank journal 128 and left front crank journal 116 to form an integral front crank assembly.

Left crank cover 17 is shown as attached to left front crank 162 by connectors 210 which may employ any desired attachment means such as adhesive or screws. It is noted that the upper portions of cranks 160 and 162, as shown, serve only to provide support for the crank covers. Right front crank journal 128 turns in right front journal bearing 208 supported on the frame as represented by right front frame stanchion 142. Left front crank journal 116 turns in left front journal bearing 206 supported on the frame as represented by left front frame stanchion 174. The drive for right crank journal 128 is front drive sprocket 124, driven by front drive chain 126 driven by front driver sprocket 186 on driven shaft 184.

Cam assembly support 200 supports leaf spring 202 as cam 204 bears against it, storing energy as floating platform 65 travels downward to supplement the "V" drive system in raising platform 65 and user U when traveling upward.

Figure 14:
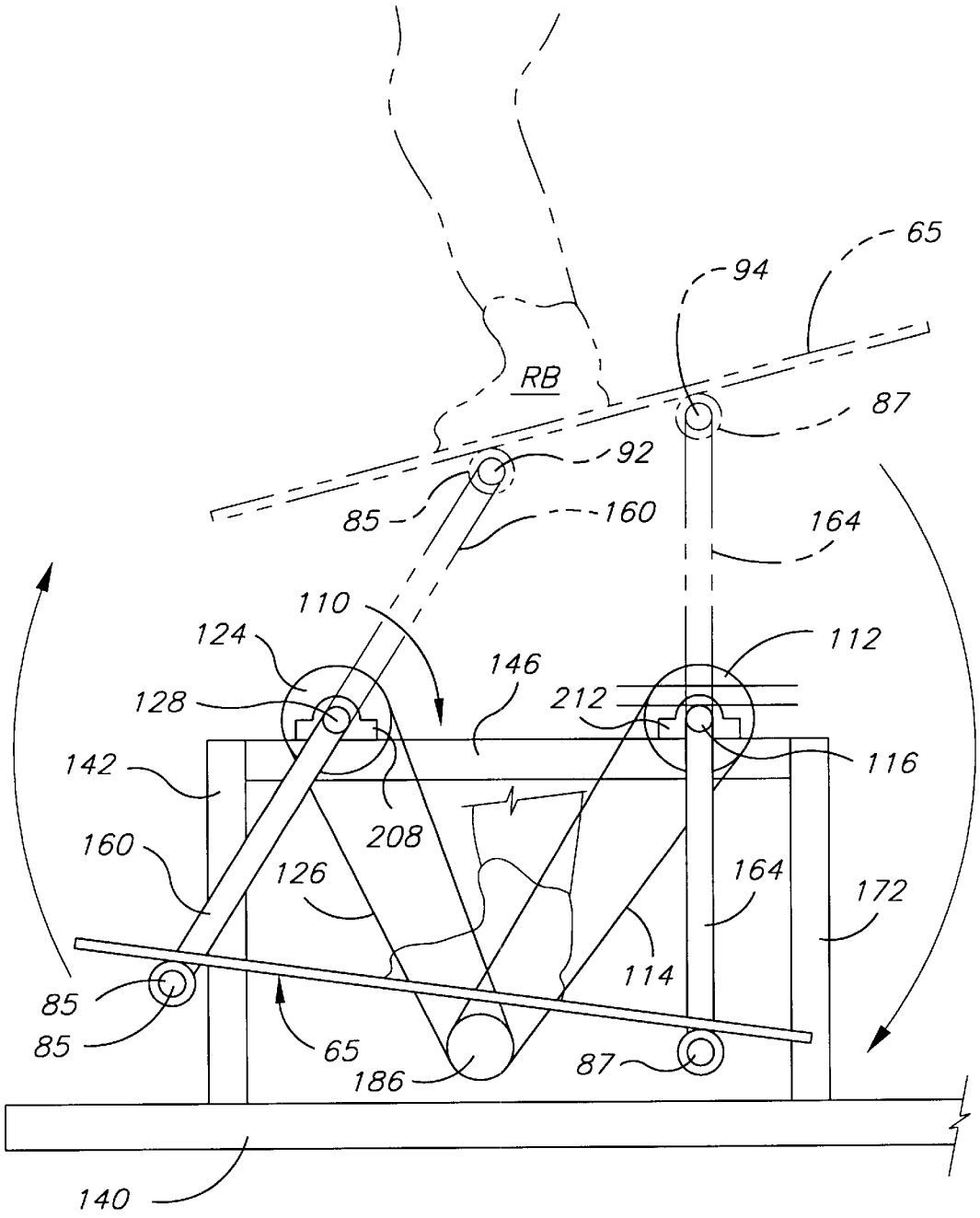
FIG. 14 is a diagrammatic sectional side view of the present invention with the left side removed illustrating the movement of the various elements of the present invention.

Referring to FIG. 14 there is shown a diagrammatic sectional side view of the right side of the inventive device with the left side removed, illustrating the movement of the various elements of the present invention. The right boot RB of the user U is shown on platform cover 65 in the upper position, resting on front right support bearing 85 connected with front crank pin 92 which is connected to right front crank 160, and on rear right support bearing 87 connected with rear crank pin 94 which is connected to right rear crank 164.(Elements are shown in dashed lines to illustrate the device in the highest position)

As shown in solid lines, platform 65 is shown in the lower position, resting on front right support bearing 85 connected with front crank pin 92 which is connected to right front crank 160, and on rear right support bearing 87 connected with rear crank pin 94 which is connected to right rear crank 164. Front right crank journal 128 turns in a clockwise direction(as shown) in right front journal bearing 208 and is turned by front drive sprocket 124 of "V" drive 110. Rear right crank 116 turns in right rear journal bearing 212 and is turned by rear drive sprocket 112. Front drive chain 126 transfers power to front drive sprocket 124 from driver sprockets 186, and rear drive chain 114 transfers power to rear drive sprocket 112 from driver sprockets 186.

The "V" drive and crank journal bearings are supported by a frame comprising right frame sloping member 140, right mounting wall 146, right front stanchion 142 and right rear stanchion 172. The cranks as shown are rotating in the direction of the arrows.

Figure 15:
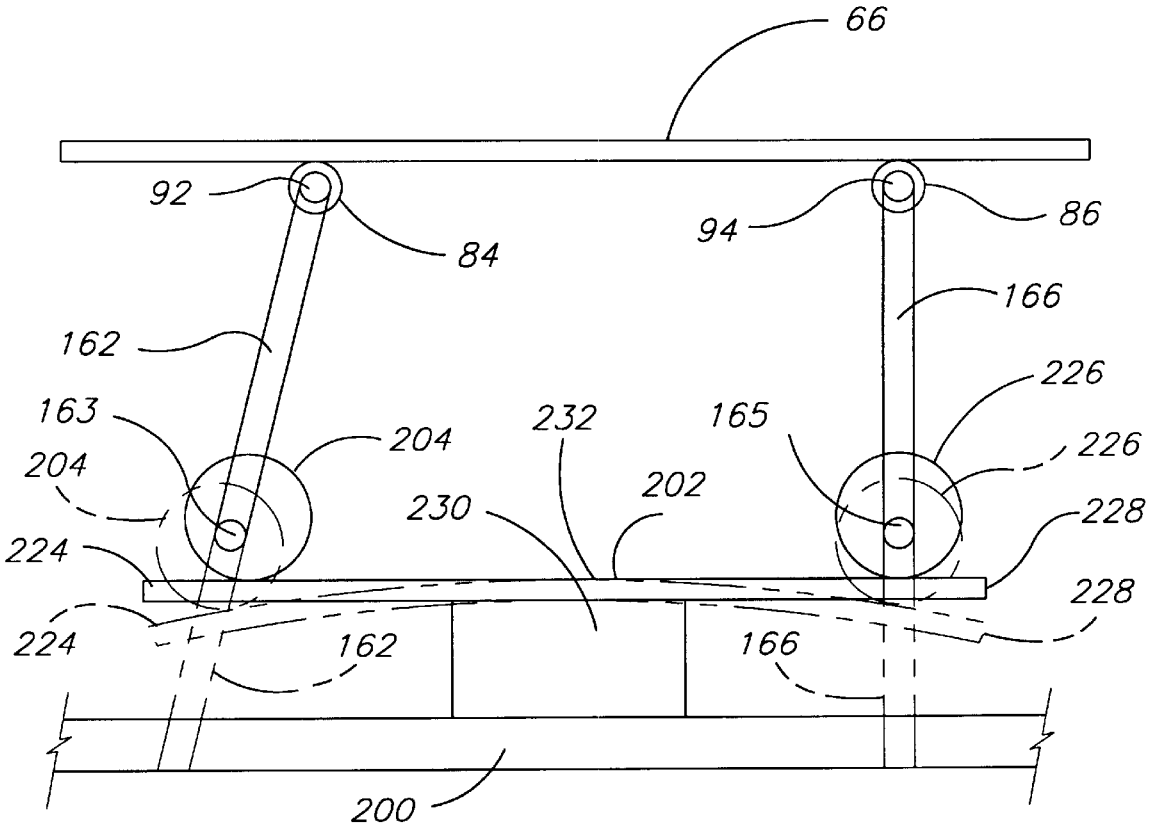
FIG. 15 is a diagrammatic side detail view illustrating the energy-storing cam and leaf spring of the present invention.

Referring to FIG. 15 there is shown a diagrammatic elevation detail view of the left side of the invention illustrating the energy-storing cam and leaf spring of FIG. 13. Floating platform 65 is supported by front left bearing 84 and rear left bearing 86. Front left bearing 84 is mounted on front crank pin 92 attached to left front crank 162 rotated by left front crank journal 163. Rear left bearing 86 is mounted on rear crank pin 94 attached to left rear crank 166 rotated by left rear crank journal 165.

As shown in solid lines front cam 204 is attached to and rotated by left front crank journal 163 and shown in the up position exerting no force on front end portion 224 of leaf spring 202. Also, rear cam 226 is attached to and rotated by left rear crank journal 165 and shown in the up position, exerting no force on rear end portion 228 of leaf spring 202. This position is assumed when the floating platform 65 is in the upper position. Leaf spring 202 is supported at the center by block 230 which is supported by cam assembly support 200.

Upon rotation of left front crank 162 and left rear crank 166 to the downward position with floating platform 65 traveling to its lower position, front cam 204 forces front end portion 224 of leaf spring 202 into a loaded downward position(shown in dashed lines) and rear cam 226 forces rear end portion 228 of leaf spring 202 into a loaded downward position. Leaf spring apex 232 is located over the center of block 230. The energy stored in the leaf spring 202 is transferred by front cam 204 and rear cam 226 to left front crank 162 via crank journal 163, and by rear cam 226 to left rear crank 166 via crank journal 165 as they begin their upward stroke, thus assisting the electric motor(see FIG. 9) in raising floating platform 65 and the user(not shown).

The inventive device may be constructed of appropriate materials such as plastic and metals for the various parts.

It is to be understood that the present invention is not limited to the embodiment described above, but encompasses any and all embodiments within the scope of the following claims.

We claim:

1. An exercise device for simulating alpine mogul skiing comprising:

a) a base having a left side and a right side and at least one cross piece;

b) a first crank assembly having first left and right parallel cranks, a first crank pin, and a first pair of left and right journals, said first cranks being separated by said first crank pin, said first pair of journals being supported by said base, said first crank assembly being rotatable through a complete circle about a first axis of rotation;

c) a second crank assembly spaced from said first crank assembly having second left and right parallel cranks, a second crank pin and a second pair of left and right journals, said second cranks being separated by said second crank pin, said second pair of journals being supported by said base, said second crank assembly being rotatable through a complete circle about a second axis of rotation, said first axis of rotation being parallel to said second axis of rotation and spaced therefrom such as to allow independent rotation of each of said first and second crank assemblies;

d) said first crank pin having first left and right bearings mounted for rotation thereon, adjacent to and inward from said first left and right cranks, and said first crank pin having a first plurality of spring mounting bushings mounted for rotation thereon and spaced between said first left and right bearings;

e) said second crank pin having second left and right bearings mounted for rotation thereon, adjacent to and inward from said second left and right cranks, and said second crank pin having a second plurality of spring mounting bushings mounted for rotation thereon and spaced between said second left and right bearings;

d) a generally rectangular platform having a first end portion and a second end portion, and a central portion, said first end portion being supported by and free to ride in a reciprocal manner on said first left and right bearings, said second end portion being supported by and free to ride in a reciprocal manner on said second left and right bearings;

e) spring mounting means located in said central portion for tethering said platform for retention in a range of locations relative to said crank pins;

f) a prime mover supported by said base; and g) a power transmitting element connecting said prime mover to at least one each of said first and said second crank journals so as to impart rotation of said first and second crank assemblies.

2. The device of claim 1, said platform further comprising:

a) a spring anchor fixedly located within said rectangular platform central portion;

b) a plurality of extension springs individually mounted between said spring anchor and said first plurality of spring mounting bushings; and c) a plurality of extension springs individually mounted between said spring anchor and a first group of said second plurality of spring mounting bushings.

3. The device of claim 1, wherein said first crank assembly and said second crank assembly rotate at the same speed and in a clockwise direction relative to said left side of said base, and said first crank assembly precedes said second crank assembly by about 30–35 degrees.

4. The device of claim 1 wherein said prime mover is an electric motor and associated drive.

5. The device of claim 4 further comprising a control pad and means connected with said control pad to selectively control the torque, speed, and related parameters of said drive.

6. The device of claim 5 further comprising a brake for dissipating electrical power developed upon the downward stroke of said first and second crank assemblies, and for precision or emergency stopping of the exercise device.

7. The device of claim 1 wherein moving mechanical parts are enclosed by at least one housing.

8. The device of claim 1 further comprising a railings attached to said base and extending around said left side, front, and right side of said base at a height such that a user standing on said platform may easily grasp said railing to maintain balance during operation of the device.

9. The device of claim 8 wherein said railing has low degrees forward pitch portions along its left and right side at a first level, high degrees forward pitch portions extending upward from said horizontal portions, and a horizontal front cross portion connecting said high pitch portions at a second level, said high degree of pitch being comparable to the pitch of ski poles used on a steep slope.

10. The device of claim 9 wherein said control pad is located on said horizontal front portion of said railing and said control pad features an emergency off switch actuated by a lanyard connected to the user so as to be activated upon the falling of the user.

11. The device of claim 5 wherein said motor drive is "V" drive comprising a driver located between and below said first and second crank assemblies, a double sprocket driven by said driver, separate chains driven by said double sprocket, and a sprocket drive located on each crankshaft assembly and driven by one of said separate chains.

12. The device of claim 11 wherein said drive system is operable by connection to a 120-volt outlet and operates to convert 120-volt single-phase current to 230-volt three-phase current to power said motor.

13. The device of claim 12 further comprising a first pair of left and right journal bearings and a second pair of left and right journal bearings wherein said first pair of left and right journals turn in a first pair of left and right journal bearings, and said second pair of left and right journals turn in a second pair of left and right journal bearings, respectively.

14. The device of claim 13 wherein said first pair of journal bearings and said second pair of journal bearings are supported by left and right forward sloping rectangular frames, each said frame comprising a front stanchion, a rear stanchion, a mounting wall and a lower member, said front and rear stanchions being connected by a mounting wall and a lower member, said first pair of journal bearings being mounted in a front upper portion of each of said mounting walls of said left and right frames, said second pair of journal bearings being mounted in a rear upper portion of each off said mounting walls of said left and right frames along a line parallel to said forward sloping frame, such that said first pair of journal bearings are located below said second pair of journal bearings, resulting in said floating platform being biased forward.

15. The device of claim 14 wherein said motor and drive is mounted on said right forward sloping lower member.

16. The device of claim 14 further comprising front and rear idler sprocket drives attached to said respective left front and rear crank journals, front and rear journal bearings mounted on said left frame mounting wall for said respective left front and rear crank journals, an idler chain rotating with said front and rear idler sprocket drives, and a tensioner for adjustably tensioning said idler chain.

17. The device of claim 14 further comprising a leaf spring having a front end portion, a rear end portion and a central portion, and a centrally located leaf spring support mounted and spaced outward from said left frame, and front and rear cams mounted on said left front and rear crank journals, respectively, said front and rear cams bearing on said leaf spring front end and rear end portions such that when the cranks of said front and rear crank journals are pointed downward the front and rear cams bend the respective portions of said leaf spring downward, thus storing energy which is released when said cranks are rotating upward, assisting in rotating said cranks and said floating support upward.

18. The device of claim 2, wherein said rectangular platform comprises a frame and a cover, said frame comprising a front end member defining said front end portion, a rear end member defining said rear end portion, a central member parallel with and centered between said front end member and said rear end member and defining said central portion, a left side member, and a right side member, said left side member and said right side member having grooves defining tracks located in their respective undersides for receiving said left front and left rear support bearings and said right front and said right rear support bearings, respectively.

19. The device of claim 18 wherein said spring anchor is said central member.

20. The device of claim 19 further comprising a depending support located at each corner of said rectangular frame, said depending supports supporting a retainer strip spaced from each of said left side member and said right side member for maintaining said platform on said support bearings.

* * * * *